US011287231B2

(12) United States Patent
Stoddart et al.

(10) Patent No.: US 11,287,231 B2
(45) Date of Patent: Mar. 29, 2022

(54) REUSABLE SIMULATED WEAPON AND TRIGGERING MECHANISM

(71) Applicant: AIRSOFT INNOVATIONS INC., Toronto (CA)

(72) Inventors: Robin Stoddart, Toronto (CA); Carlton Ie Loong Chong, Toronto (CA)

(73) Assignee: AIRSOFT INNOVATIONS INC., Toronto (CA)

( * ) Notice: Subject to any disclaimer, the term of this patent is extended or adjusted under 35 U.S.C. 154(b) by 430 days.

(21) Appl. No.: 16/479,739

(22) PCT Filed: Jan. 23, 2017

(86) PCT No.: PCT/IB2017/050347

§ 371 (c)(1),
(2) Date: Jul. 22, 2019

(87) PCT Pub. No.: WO2018/134648

PCT Pub. Date: Jul. 26, 2018

(65) Prior Publication Data

US 2021/0356240 A1 Nov. 18, 2021

(51) Int. Cl.
*F42B 8/26* (2006.01)

(52) U.S. Cl.
CPC ..... *F42B 8/26* (2013.01)

(58) Field of Classification Search
CPC ..... F42B 8/26; F42B 8/00; F42B 8/20; F42B 8/22
USPC ..... 102/498
See application file for complete search history.

(56) References Cited

U.S. PATENT DOCUMENTS

| | | | | |
|---|---|---|---|---|
| 1,481,635 | A | 1/1924 | Councilman | |
| 1,517,810 | A | 12/1924 | Wiley | |
| 3,557,701 | A * | 1/1971 | Arnell | F42C 9/12 102/260 |
| 4,932,672 | A | 6/1990 | Tippmann | |
| 6,871,594 | B1 | 3/2005 | Estrella | |
| 9,423,225 | B1 * | 8/2016 | Yoon | F42B 12/50 |

(Continued)

OTHER PUBLICATIONS

ISA/CA, International Search Report and Written Opinion, dated Oct. 12, 2017, re PCT International Patent Application No. PCT/IB2017/050347.

(Continued)

*Primary Examiner* — John Cooper
(74) *Attorney, Agent, or Firm* — Perry + Currier Inc.

(57) ABSTRACT

A reusable simulated weapon device includes a holding chamber and an expansion chamber for receiving expanding gas. A shuttle is slidable between a closed position that blocks communication between the holding chamber and the expansion chamber and an open position that allows communication. A pilot valve allows pressurized gas in the holding chamber to drive the shuttle into the open position. A firing pin opens the pilot valve. The firing pin has an armed position, in which a protrusion engages with a recess to hold the firing pin against a spring. The firing pin can be released from the armed position in response to an impact to the device. When the firing pin is released, the spring drives the firing pin to actuate the pilot valve, causing the shuttle to slide from the closed position to the open position to allow gas to move into the expansion chamber.

12 Claims, 11 Drawing Sheets

(56) References Cited

U.S. PATENT DOCUMENTS

| | | | | |
|---|---|---|---|---|
| 2006/0233050 | A1 | 10/2006 | Unsworth et al. | |
| 2007/0283833 | A1* | 12/2007 | George Ellis | F42B 27/08 102/498 |
| 2010/0199960 | A1 | 8/2010 | Chong | |
| 2014/0130695 | A1* | 5/2014 | Chong | F42B 8/26 102/334 |

OTHER PUBLICATIONS

Wikipedia, "RGO hand grenade", last edited on Aug. 29, 2018. Wikimedia Foundation, Inc. URL: https://en.wikipedia.org/wiki/RGO_hand_grenade.

Empire-Of-Games.Ru, "Weapons of Vietnam: Battlefield Vietnam: Manual Fragmentation Grenades (information sheet)" [with English Google machine translation]. Feb. 10, 2013. Retrieved from the Internet on Jan. 31, 2020 from URL: http://empire-of-games.ru/art_24807.html http://empire-of-games.ru/gl__url/gamer.ru/system/attached_images/images/000/298/850/original/65492_103122702_698949lt9_1_.jpg?1293616840.

Weaponland.Ru, "Hand grenade RGN / RGO" Posted by User: Mercenary on Feb. 22, 2009. [With Machine Translation] URL: http://weaponland.ru/board/ruchnaja_granata_rgn_rgo/24-1-0-140.

WHQ-Forum, Screencap of Forum Thread Post #170 with Image, dated Jan. 27, 2018, 14:08, posted by User: SLAP URL: http://www.whq-forum.de/invisionboard/index.php?showtopic=27805&st=150&p=1406918&#entry1406918.

Department of the Army, "Field Manual No. 3-23.30 Grenades and Pyrotechnic Signals: Chapter 1: Types of Hand Grenades" Washington, DC, Sep. 1, 2000.

PCT/IB2017/050347, Reusable Simulated Weapon and Triggering Mechanism, Jan. 23, 2017.

* cited by examiner

REUSABLE SIMULATED WEAPON AND TRIGGERING MECHANISM

FIELD

The present invention relates to reusable simulated weapons such as those that eject projectiles, marking powder, liquid paint, or emit a loud sonic report.

BACKGROUND

Reusable simulated weapons, such as simulated grenades, are known to be capable of resetting and reloading. However, conventional reloadable and resettable devices often perform poorly. Conventional devices generally have one or more significant deficiencies which result in them having: poor triggering reliability, frustrating resetting procedures, high manufacturing costs, high costs of consumables, or an unimpressive and weak effect.

Many kinds of reusable simulated weapons are impact triggered. In the example of a simulated grenade, the impact of the grenade with the ground, after having been thrown, triggers the effect. A typical prior art impact-triggered device is costly to manufacture and frustrating to reset. Its triggering mechanism, while perhaps reliable, often includes several hardened components that are costly to manufacture and require complicated reassembly to reset for subsequent uses.

Regarding the effect itself, many prior attempts to provide a loud sonic report require costly consumables or employ dangerous pyrotechnic charges which must be handled as hazardous materials.

As such, there is a need for a reliable, safe, and efficient reusable simulated weapon that provides an impressive effect.

SUMMARY

The present invention aims to solve at least one of the problems discussed above.

According to one aspect of the present invention, a reusable simulated weapon device includes a body defining a holding chamber for holding a pressurized gas, the body further defining an expansion chamber in communication with the holding chamber for receiving expanding gas from the holding chamber. The device further includes a shuttle slidable between a closed position that blocks communication between the holding chamber and the expansion chamber and an open position that allows communication between the holding chamber and the expansion chamber. The shuttle has a pilot valve that, when opened, causes pressurized gas in the holding chamber to drive the shuttle from the closed position to the open position. The device further includes a firing pin for opening the pilot valve. The firing pin has an armed position, in which a protrusion engages with a recess to hold the firing pin with respect to the body against a spring. One of the protrusion and the recess is disposed at the firing pin and the other of the protrusion and the recess is disposed at the body. The protrusion and recess are shaped to release the firing pin from the armed position in response to an impact to the body. The spring is positioned to drive the firing pin, when released from the armed position, to actuate the pilot valve, causing the shuttle to slide from the closed position to the open position to allow gas to move into the expansion chamber.

The body may be configured to hold a rupturable element that encloses the expansion chamber, the rupturable element configured to rupture in response to pressure of gas in the expansion chamber, so as to emit a sound.

The rupturable element may be a membrane, and the device may further include a clamp ring within the body for clamping a perimeter of the membrane to the body, the clamp ring being made of a material that is softer than the body. The clamp ring may have a contour that forms a contour in the membrane.

The protrusion may extend from the body and the recess may be on the firing pin.

The firing pin may include a bearing portion having a concave surface that defines the recess, the concave surface for contact with the protrusion in the armed position.

The firing pin may include a pin portion and the bearing portion as separate pieces, the pin portion for actuating the pilot valve, the firing pin further comprising a resilient member disposed between the pin portion and the bearing portion for absorbing impact to reduce damage to the concave surface by the protrusion.

The concave surface may have a frustoconical shape.

The protrusion may be beveled to complement the frustoconical shape of the concave surface.

The firing pin may include a pin portion for actuating the pilot valve and a rear portion, the protrusion and recess being located along the length of the firing pin between the pin portion and the rear portion, the rear portion being sized to provide inertia to disengage the protrusion and recess in response to the impact to the body.

The body may include at least one hole positioned near the rear portion of the firing pin, the hole for receiving a safety pin that holds the firing pin in the armed position.

The body and shuttle may define a driving chamber in communication with the holding chamber as controlled by the pilot valve, gas pressure in the driving chamber driving the shuttle from the closed position to the open position, the driving chamber having an passage through which a pin portion of the firing pin extends to actuate the pilot valve, the firing pin being shaped to seal the passage when the pin portion actuates the pilot valve.

The pin portion of the firing pin and the passage into the driving chamber may be shaped to allow gas to pass through the opening when the firing pin is in the armed position.

These and other aspects of the present invention will be discussed in detail below.

BRIEF DESCRIPTION OF THE DRAWINGS

The drawings illustrate, by way of example only, embodiments of the present invention.

DETAILED DESCRIPTION

Figure 1:
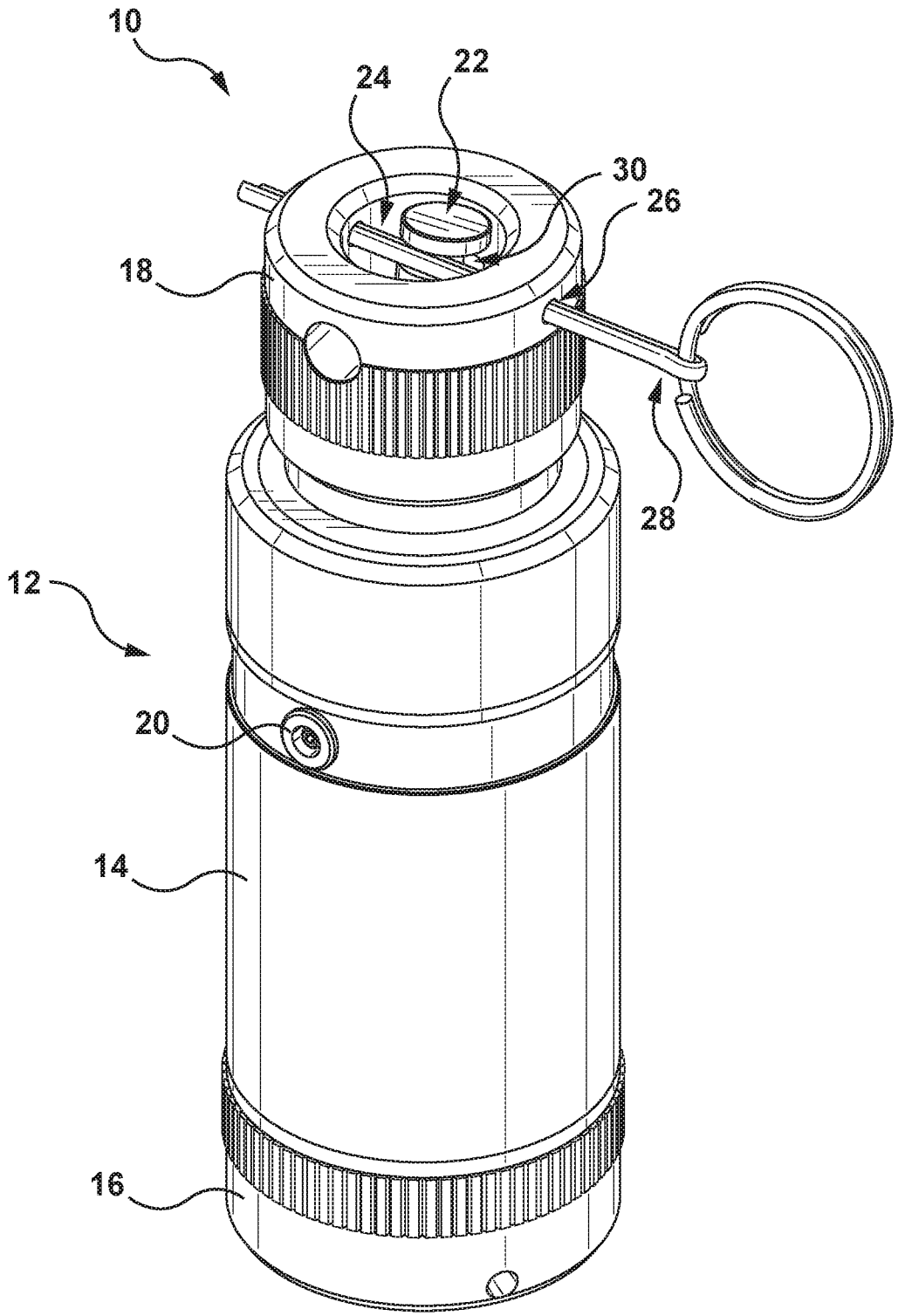
FIG. 1 is a perspective view of a reusable simulated weapon according to the present invention.

FIG. 1 shows a reusable simulated weapon 10 according to the present invention. In this embodiment, the reusable simulated weapon 10 is a sound-emitting grenade. In other embodiments, the techniques discussed herein can be applied to other kinds of reusable simulated weapons, such as those that eject powder, paint, or non-lethal projectiles. Any of such embodiments can be used in games, tactical training, and similar activities.

The reusable simulated weapon 10 includes a cylindrical body 12 composed of three portions that are thread connected. The portions are a main body 14, an end cap 16 thread connected at one end of the main body 14, and a firing pin holder 18 thread connected at the other end of the main body 14. The body 12 is made from turned aluminum. In other embodiments, different numbers and arrangements of body portions can be used, different materials can be used, and connection types other than threading can be used.

The reusable simulated weapon 10 further includes a fill valve 20 at the main body 14 for filling a holding chamber inside the main body 14 with pressurized gas, such as propane at pressures available to the public. It is contemplated that propane will be in both gas and liquid phase within the holding chamber, though this is not strictly necessary. Further, it should be noted that references to "gas" herein are to be taken to mean a material in gas phase or in both gas and liquid phases. In addition, the term "pressurized" refers to any suitable pressure above ambient pressure outside the weapon 10. Note that, while combustible gas, such as propane, can be used to provide pressure to operate the reusable simulated weapon 10, such gas is not meant to combust during normal operation of the simulated weapon 10.

The firing pin holder 18 holds a firing pin 22 and surrounds the firing pin 22 to protect the firing pin 22 from unintended contact which would accidentally trigger the reusable simulated weapon 10. Specifically, the firing pin holder 18 includes a cylindrical cavity 24 in which the firing pin 22 is mainly situated. The firing pin 22 does not extend outside the end of the firing-pin cavity 24, but the firing pin 22 is viewable and accessible through the cavity 24.

The firing pin holder 18 includes a pair of aligned holes 26 for receiving a safety pin 28. The holes 26 are positioned near the rear portion of the firing pin 22 and extend across the firing-pin cavity 24. The safety pin 28 fits into a groove 30 in the rear portion of the firing pin 22 and holds the firing pin 22 in an armed or cocked position, illustrated. Removal of the safety pin 28 allows the firing pin 22 to tilt, due to its own inertia, to trigger operation of the reusable simulated weapon 10.

Figure 2:
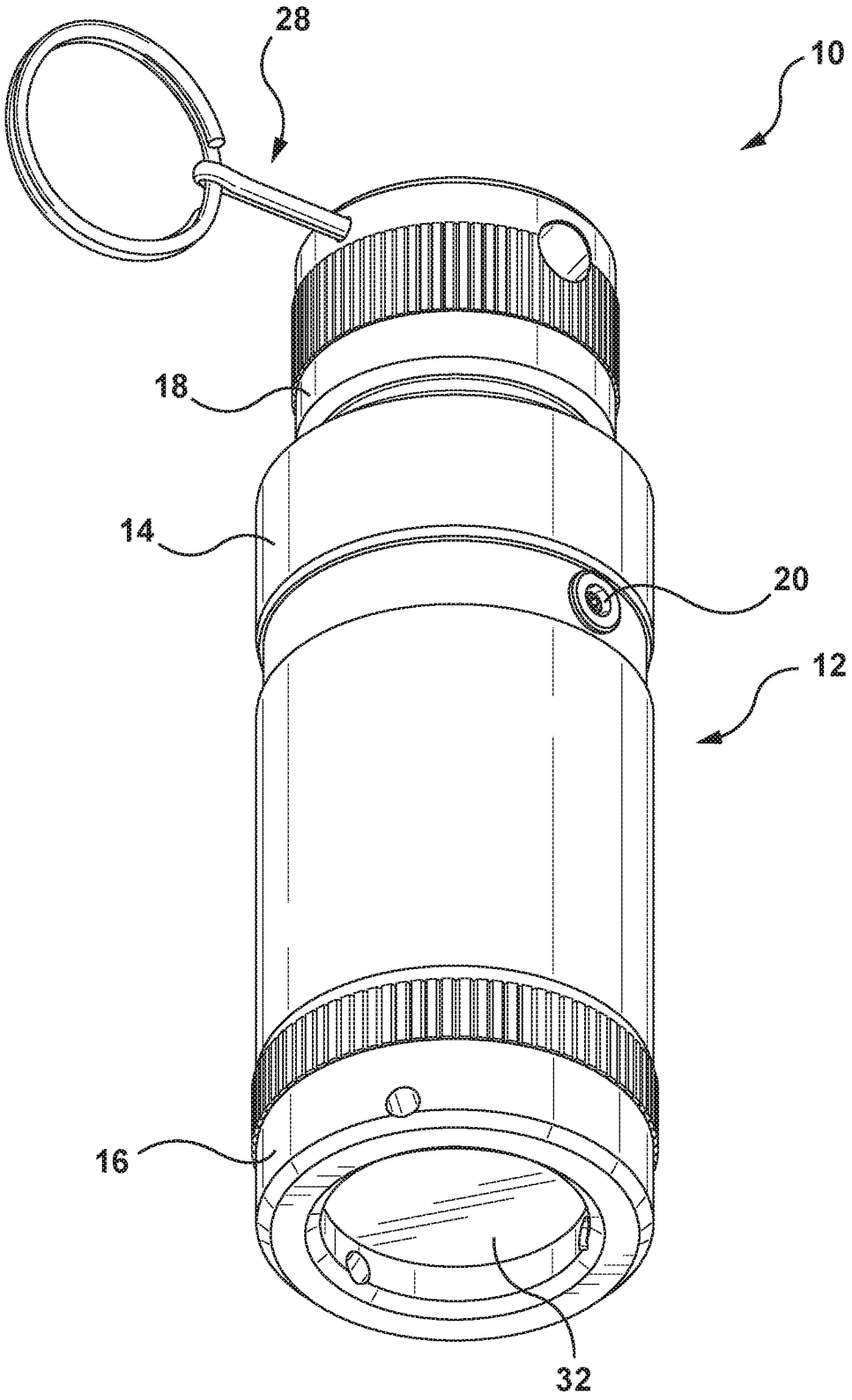
FIG. 2 is another perspective view of a reusable simulated weapon, showing the rupturable element.

To operate the reusable simulated weapon 10, the users pulls the safety pin 28, thereby freeing the firing pin 22 to move. The user then throws or drops the weapon 10 and the resulting impact causes the firing pin 22 to move, so as to trigger the release of pressurized gas held in the holding chamber. In this embodiment, the released gas ruptures a rupturable element 32 (FIG. 2), such as a thin membrane, held by the end cap 16. This produces a sound that is the desired effect of the reusable simulated weapon 10. In other embodiments, a charge of powder, paint, and/or projectiles (e.g., BBs or pellets) are provided within the reusable simulated weapon 10 and the escaping gas propels such to achieve its effect.

Figure 3:
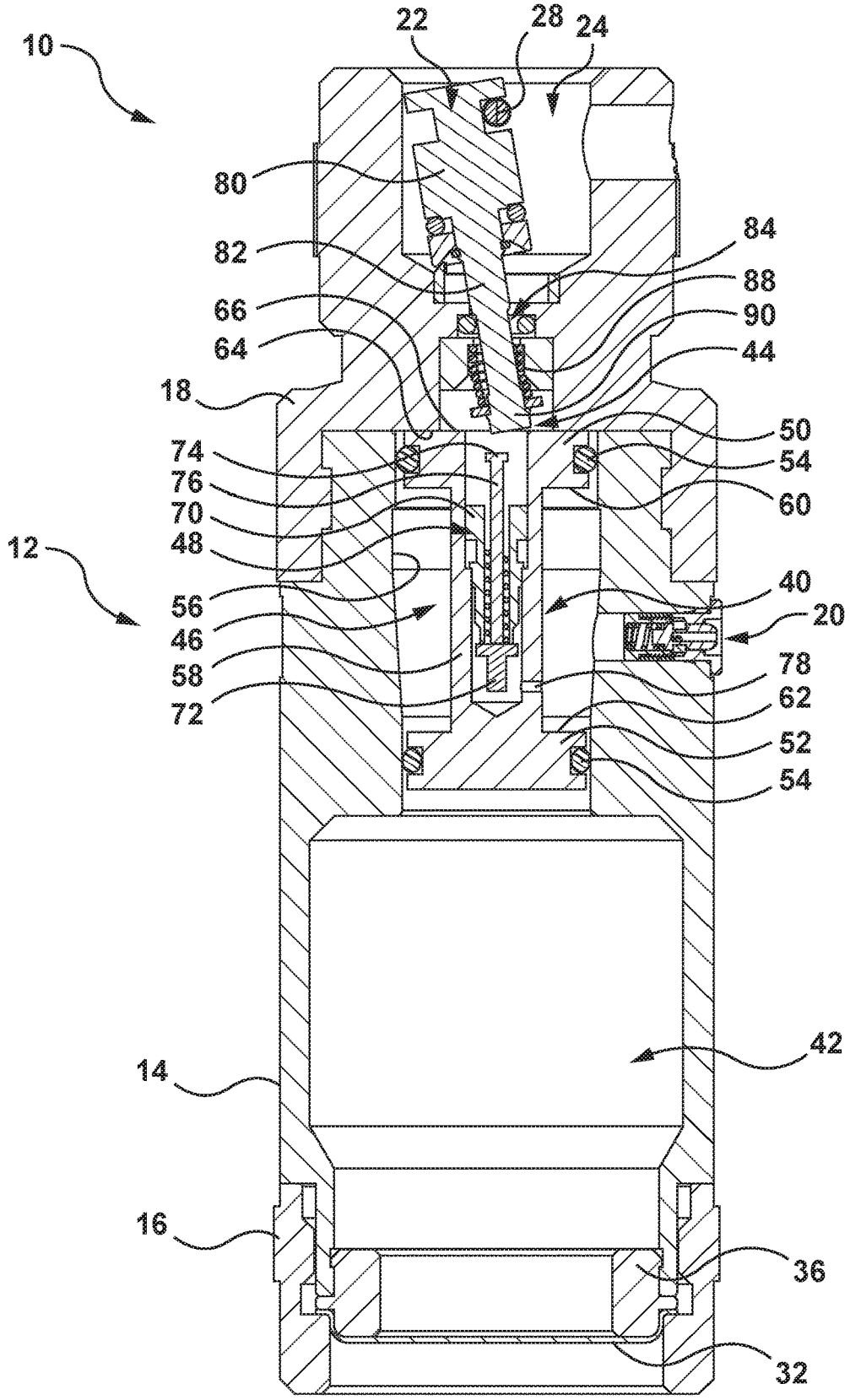
FIG. 3 is a cross-sectional view of the reusable simulated weapon.

The internal and operational structures of the reusable simulated weapon 10 will now be discussed with reference to FIG. 3, which shows a cross section of the weapon 10.

The body 12 defines a holding chamber 40, an expansion chamber 42, and a driving chamber 44. The chambers 40-44 mutually communicate in a controlled manner, as governed by a shuttle 46 and its contained pilot valve 48.

The shuttle 46 is slidable between a closed position (shown) that blocks communication between the holding chamber 40 and the expansion chamber 42 and an open position (shown in FIG. 6E) that allows communication between the holding chamber 40 and the expansion chamber 42. The pilot valve 48 controls flow of gas from the holding chamber to the driving chamber 44 to effect driving of the shuttle 46 from the closed position to the open position.

The holding chamber 40 is configured to hold compressed gas under pressure. In this embodiment, the holding chamber 40 is a generally cylindrical region within the main body 14. One end of the holding chamber 40 communicates with the driving chamber 44 and the opposite end of the holding chamber 40 communicates with the expansion chamber 42. In this embodiment, the shuttle 46 is slidable within the holding chamber 40.

The shuttle 46 includes two cylindrical end portions, namely a piston 50 and a main valve 52, sized to fit within the holding chamber 40 and having O-rings 54 or other seal elements that form seals with the inner wall 56 of the holding chamber 40. The piston 50 is located between the holding chamber 40 and the driving chamber 44 and is driven by pressure in the driving chamber 44 to operate the shuttle 46. The main valve 52 seals the expansion chamber 42 from the holding chamber 40 to prevent gas from communicating into the expansion chamber 42 in the closed position. The piston 50 and main valve 52 are connected by an elongate neck 58, which may also be generally cylindrical and is of smaller diameter than the piston 50 and main valve 52 to leave space in the holding chamber 40 to accommodate a charge of pressurized gas.

With pressurized gas in the holding chamber 40 and without pressure in the driving chamber 44, the shuttle 46 does not move because pressure on the inside surface 62 of the main valve 52 is countered by pressure on the inside surface 60 of the piston 50. In this embodiment, the inner wall 56 in the region of the piston 50 is of slightly larger diameter than in the region of the main valve 52. This results in a net pressure force due that urges the piston 50 into a stopper surface 64 at the end of the holding chamber 40 to keep the seal between the main valve 52 and inside wall 56 of the holding chamber 40. This gives the shuttle 46 the tendency to remain in the closed position, even under small impacts to the body 12 of the weapon 10, which might otherwise move the shuttle 46 towards the open position and result in unintended triggering of the weapon 10.

The expansion chamber 42 is, in this embodiment, a generally cylindrical region within the main body 14 that is closed off by the rupturable element 32 at one end and by the main valve 52 at the other end. The perimeter of the rupturable element 32 is sandwiched between an clamp ring 36 attached to the main body 14 and the end cap 16. When gas is present within the expansion chamber 42 at sufficient pressure, the rupturable element 32 ruptures and a sound is produced. In this embodiment, the expansion chamber 42 is concentric with the holding chamber 40 and is of a larger diameter than the holding chamber 40. Gas is transferred from the holding chamber 40 into the expansion chamber 42 by the loss of seal that is caused by movement of the main valve 52 into the expansion chamber 42.

The driving chamber 44 is, in this embodiment, a generally cylindrical region within the firing pin holder 18 and main body 14. The driving chamber 44 is bounded by the firing pin 22 at one end and the piston 50 at the other end. In this embodiment, the driving chamber 44 is concentric with the holding chamber 40. The diameter of the driving chamber 44 is smaller than the diameter of the holding chamber 40, so that a driving surface 66 of the piston 50 is exposed to any gas and exerted pressure within the driving chamber 44. The area of exposed driving surface 66 is selected so that pressure within the driving chamber 44 overcomes static friction of the shuttle 46 within the holding chamber 40 and any net closing force on the inside surface 60 of the piston 50 to accelerate the shuttle 46 into the open position. Moreover, the area of exposed driving surface 66 is selected so that this acceleration is quick enough to dump pressurized gas into the expansion chamber 42 at a rate sufficient to cause the rupturable element 32 or other charge to produce the desired effect, recognizing that a faster expansion of gas may result in a louder or more sudden sound or more impressive discharge of projectiles, powder, or paint.

The relative volumes of the chambers 40-44 can be selected in view of the type and pressure of gas used. It is contemplated that carefully selected volumes, specifically of the holding chamber 40 and the expansion chamber 42, can be used to tune the specific sound made by rupture of the rupturable element 32. In some embodiments, the volume of the expansion chamber 42 is preferably sized to provide a volume large enough to expand most or all of the material in liquid phase contained in the holding chamber 40 into gas at a pressure close to the gas's saturation pressure at ambient temperature. In such embodiments that include a rupturable element, the expansion chamber 42 preferably reaches a pressure close to this saturation pressure and the rupturable element is configured to rupture just under this saturation pressure to maximize the loudness of the sonic report.

In embodiments for emitting paint, powder, or projectiles, the expansion chamber 42 may be configured to hold a charge of same. In such embodiments, the expansion chamber 42 may be of increased or reduced volume, provided that the size of the expansion chamber 42 is sufficient to accommodate movement of the main valve 52.

The pilot valve 48 is situated within the shuttle 46, travels with the shuttle, and controls communication of pressurized gas from the holding chamber 40 to the driving chamber 44. The neck 58 of the shuttle 46 defines an interior space that accommodates the pilot valve 48. The pilot valve 48 includes a body 70 that defines a passage extending from an inlet that is sealed by a seal 72 to an outlet in the region of the free end 74 of actuating pin 76. The actuating pin 76 is connected to the seal 72 and is spring-biased to pull the seal 72 (upwards in the figure) into contact with the body 70 to seal the passage. The neck 58 of the shuttle 46 includes an inlet port 78 that communicates the holding chamber 40 with the interior of the shuttle 46 at the region of the seal 72. When the free end 74 of the actuating pin 76 is pushed against the spring bias (downwards in the figure), the seal 72 departs from the body 70, opening the passage to allow gas to flow from the region around the seal 72 to the region around the free end 74 of actuating pin 76. Hence, the pilot valve 48, when opened, causes gas in the holding chamber to enter the driving chamber 44 and drive the shuttle 46 from its closed position to its open position. The pilot valve 48 is actuated by the firing pin 22. US Patent Publication No. 2014/0014197 shows a similar example pilot valve that can be used with the present invention.

Figure 4:
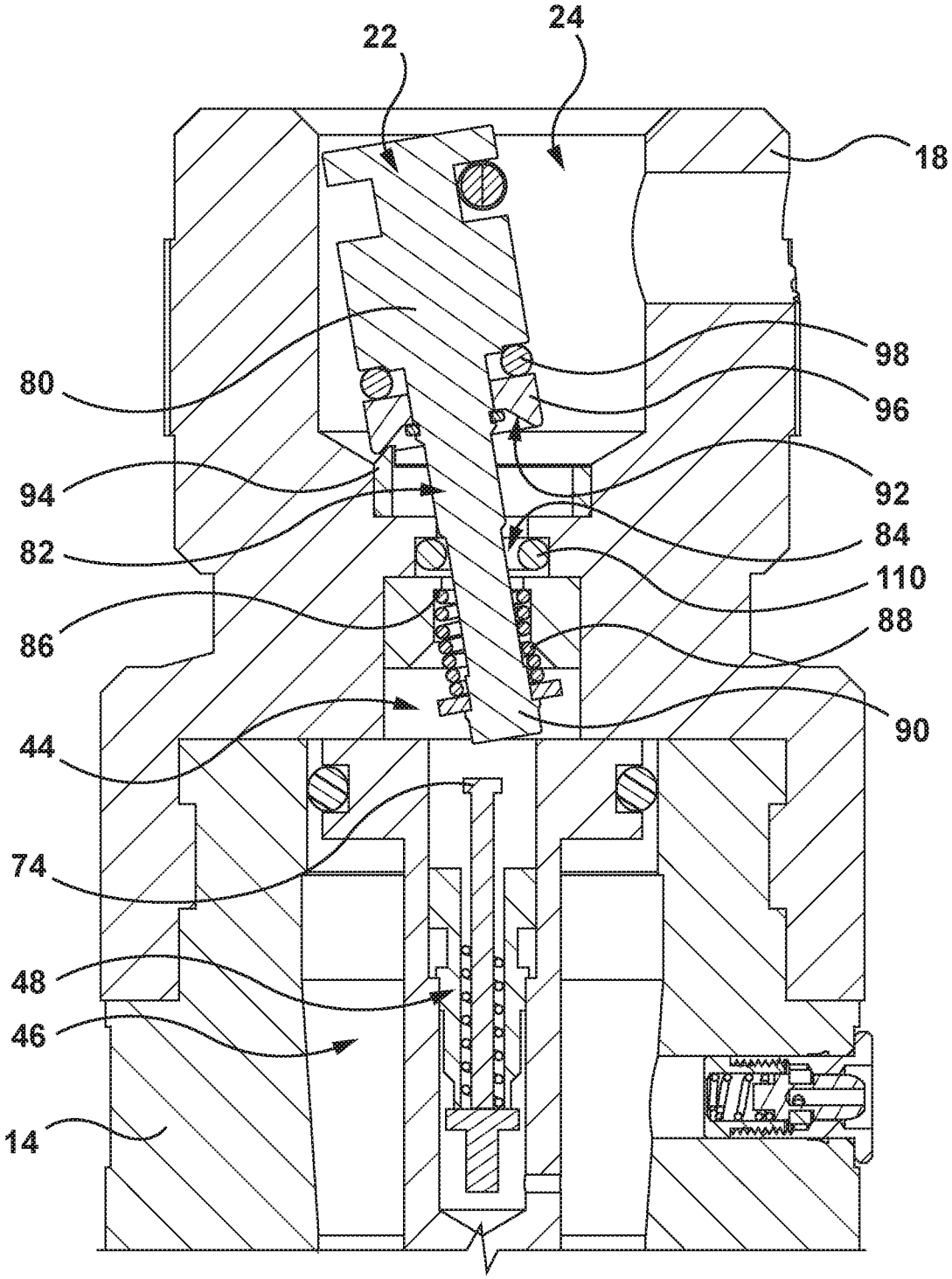
FIG. 4 is a close-up cross-sectional view of the reusable simulated weapon in the region of the firing pin.

The firing pin 22 is a generally cylindrical elongate body that includes a rear portion 80 and a pin portion 82. The firing pin 22 may be made of brass or similar material. The firing pin 22 is positioned in the cavity 24 within the firing pin holder 18 with the pin portion 82 extending through a firing-pin passage 84 in a backing wall 86 of the driving chamber 44, into the driving chamber 44 and towards the pilot valve 48, as shown in FIG. 4. The rear portion 80 extends in an opposite direction. A coil spring 88 is provided around the pin portion 82 between the end 90 of the pin portion 82 and the backing wall 86 of the driving chamber 44 to spring-load the firing pin 22 and urge the end 90 of the pin portion 82 into contact with the free end 74 of the pilot valve 48.

The firing pin 22 includes a recess 92 that is engageable with a protrusion 94 that extends from the inside of the firing pin holder 18. In other embodiments, the recess is in the firing pin holder 18 and the protrusion extends from the firing pin 22. The protrusion 94, which may be termed a sear, and the recess 92 are located along the length of the firing pin 22 between the pin portion 82 and the rear portion 80. Engagement of the recess 92 and protrusion 94 holds the firing pin 22 with respect to the firing pin holder 18 and prevents the firing pin 22 from moving towards the pilot valve 48. When the protrusion 94 and recess 92 are so engaged, the firing pin 22 is in its armed position.

The protrusion 94 and recess 92 shaped to release the firing pin 22 from the armed position in response to an impact to the body 12, such as an impact caused by throwing or dropping the reusable simulated weapon 10. Moreover, the rear portion 80 of the firing pin 22 is sized to provide inertia to assist in disengaging the protrusion 94 and recess 92. That is, the mass of the rear portion 80 and the moment arm from its center of mass to the contact point of the protrusion 94 and recess 92 aids in breaking static friction between the protrusion 94 and recess 92. The mass and moment arm can be selected to customize the sensitivity of the firing pin 22, with larger mass and larger moment arm generally corresponding to greater sensitivity.

The spring 88 is positioned to drive the firing pin 22 to actuate the pilot valve 48 by ramming the end 90 of the firing pin into the end 74 of actuating pin 76 of the pilot valve 48, when the firing pin 22 is released. This actuates the pilot valve 48, causing pressure to build in the driving chamber 44 and push the shuttle 46 to slide from the closed position to the open position. The result is that the expansion chamber 42 fills with gas, which ultimately ruptures the rupturable element 32 to emit a sound or discharges another kind of charge.

The shape and inertia of the firing pin 22 in combination with the protrusion 94 and recess 92 provide for reliable triggering action. In addition, the spring 88 in combination with the protrusion 94 and recess 92 provides for a simple resetting procedure, in that the firing pin 22 need only be pushed against the spring 88 and then tilted to engage the protrusion 94 and recess 92 to enter the armed position.

In this embodiment, the firing pin 22 also includes a bearing portion 96 that defines the recess 92. The rear portion 80 and the bearing portion 96 are separate pieces. A resilient member 98, such as an elastomeric O-ring, is disposed between the rear portion 80 and the bearing portion 96 for absorbing impact to reduce damage to the recess 92 that might be caused by the protrusion 94 or vice versa. Such damage may otherwise reduce the reliability of triggering mechanism, in that damaged areas of the recess 92 would offer increased or decreased resistance to disengagement from the protrusion 94. The resilient member 98 is sandwiched between an annular surface of the rear portion 80 and a complementary annular surface of the bearing portion 96 that is opposite the face having the recess 92. The bearing portion 96 has an annular shape and the pin portion 82 of the firing pin 22 extends through the central hole in the bearing portion 96. The resilient member 98 may be considered a kind of shock absorber that maintains the reliability and prolongs the service life of the mechanism.

Figure 5:
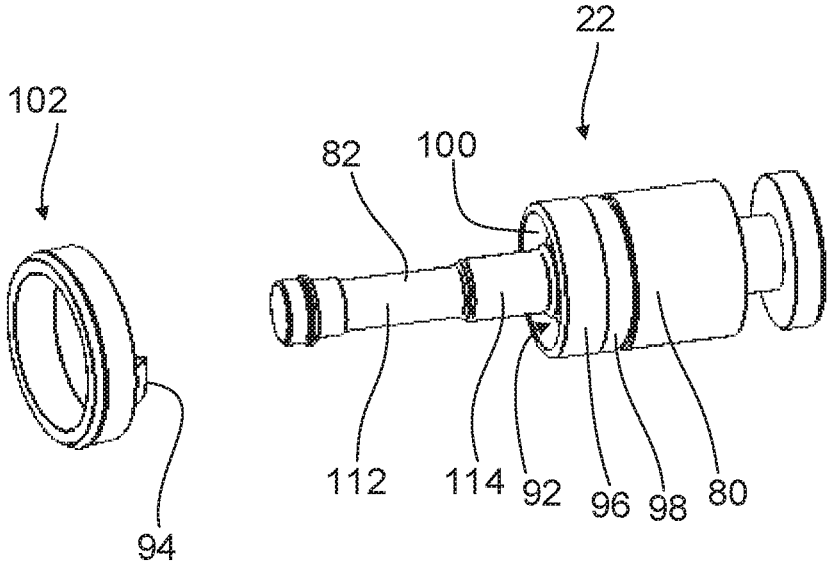
FIG. 5 is a perspective view of the firing pin and the ring that carries the protrusion.

In this embodiment, as shown in FIG. 5, the recess 92 is defined by a concave surface 100 that contacts the protrusion 94 in the armed position. Specifically, in this embodiment, the concave surface 100 has a frustoconical shape. Further, the protrusion 94 is beveled to complement the frustoconical shape of the concave surface 100. In this embodiment, the protrusion 94 extends from a ring 102 that is seated within a complementary bore in the firing pin holder 18.

Referring back to FIG. 4, the passage 84 between the firing-pin cavity 24 and the driving chamber 44 is provided with a seal 110, such as an O-ring, and the firing pin 22 is shaped to seal the passage 84 when the pin portion 82 actuates the pilot valve 48. In this embodiment, the pin portion 82 steps up in diameter from a lower length 112 (FIG. 5) that extends through the passage 84 in the armed position to an upper length 114 that has a greater diameter to form a seal with the O-ring 110 when then firing pin 22 is released. The smaller diameter of the lower length 112 provides a gap for gas to escape, which may prevent unwanted discharge of the weapon 10 if there is a leak at the shuttle 46 or pilot valve 48. The gap is sealed when the firing pin 22 is released to prevent escape of gas through the passage 84 which would reduce the effect of the weapon 10.

FIGS. 6A-6E show a process of operating the reusable simulated weapon 10.

Figure 6A:
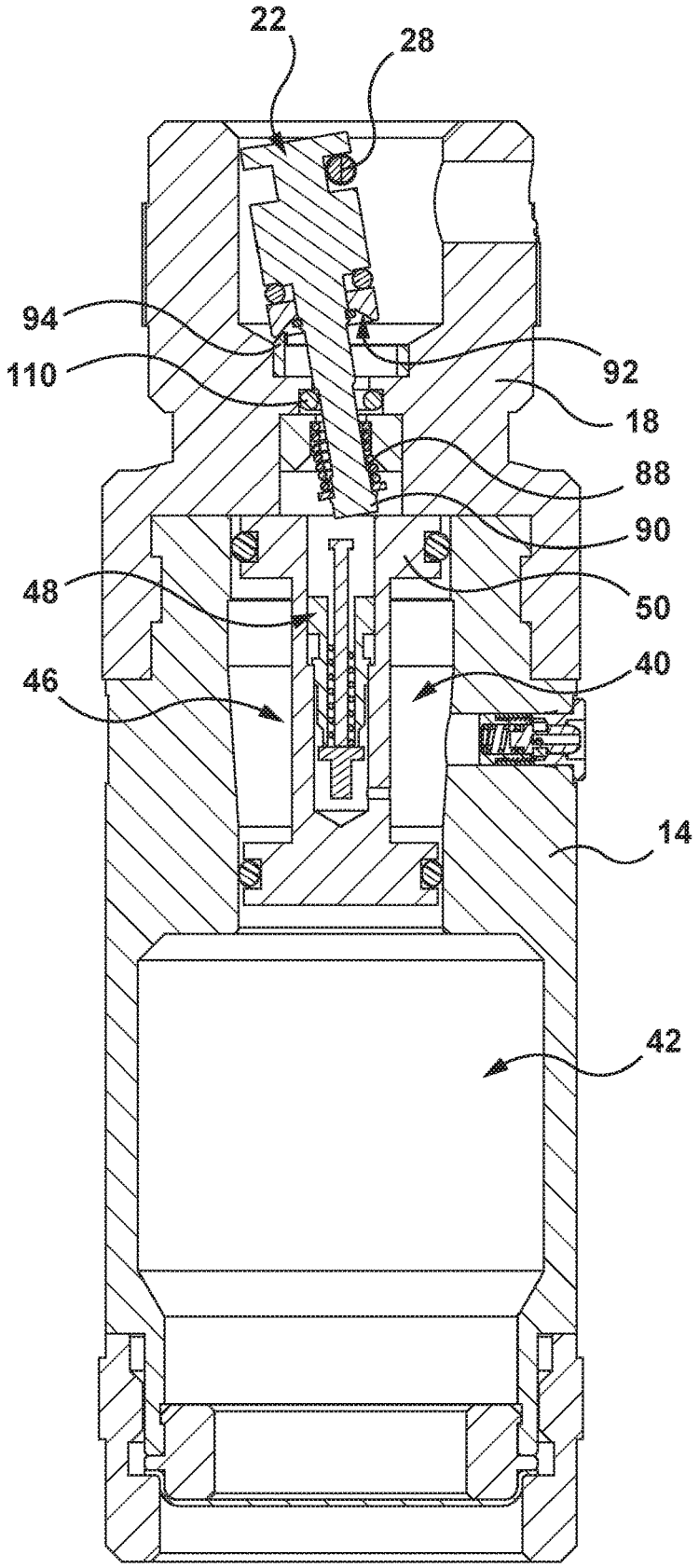
FIGS. 6A-6E are cross-sectional views showing a sequence of operation.

As shown in FIG. 6A, and the firing pin 22 has been moved to its armed position by, for example, a user unthreading the firing pin holder 18 from the main body 14 and pressing on the end 90 of the firing pin 22 with a finger, causing the firing pin 22 to move against the spring 88 to engage the recess 92 with the protrusion 94. Engagement of the recess 92 with the protrusion 94 holds the firing pin 22 in the armed position against the force exerted by the spring 88. The safety pin 28 can be inserted at this time to prevent inadvertent triggering. At the same time, the shuttle 46 can be pushed to its closed position (shown), in which the expansion chamber 42 is isolated from the holding chamber 40. The firing pin holder 18 is then reattached to the main body 14, and the holding chamber 40 is filled with pressurized gas. Any gas leaking through the pilot valve 48 or leaking past the piston 50 is free to escape between the firing pin 22 and the seal 110.

Figure 6B:
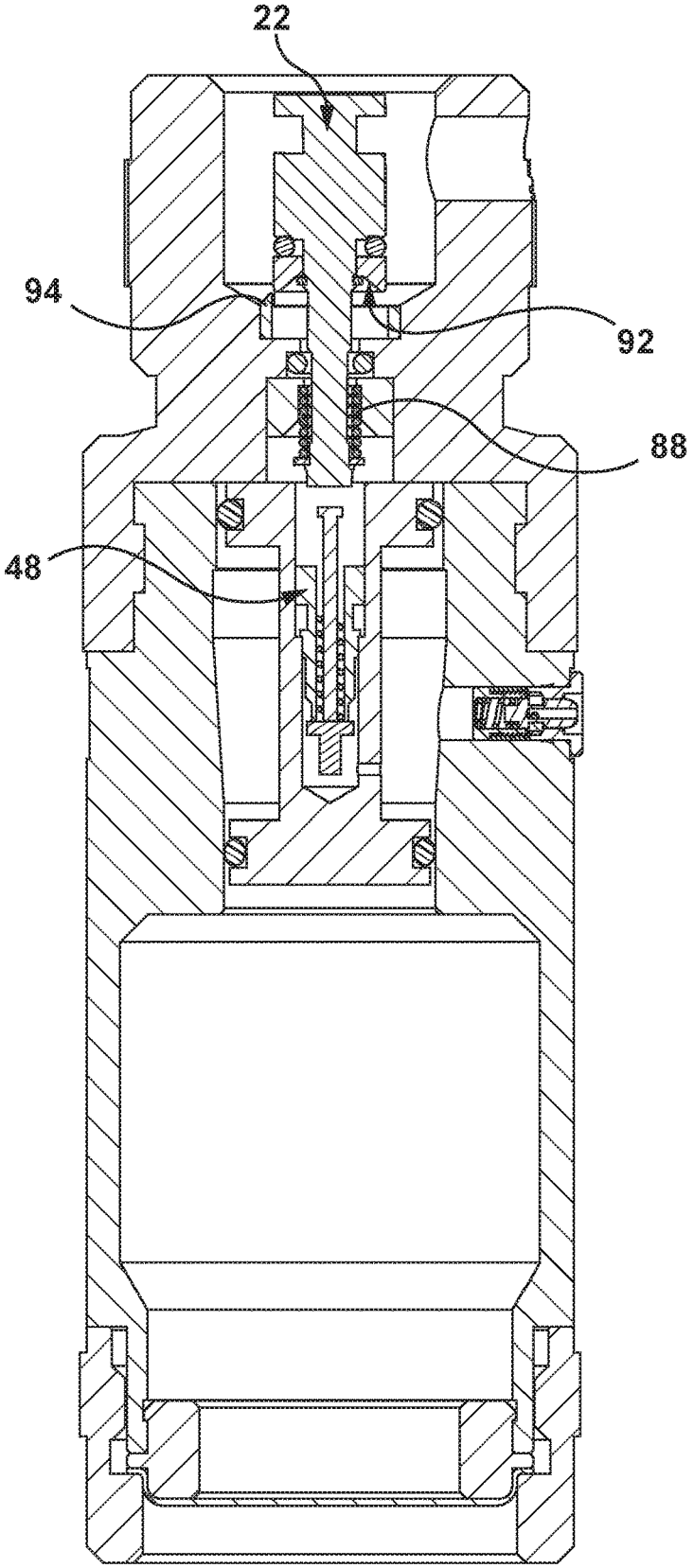

As shown in FIG. 6B, the safety pin 28 has been removed and the reusable simulated weapon 10 has undergone an external impact that causes the recess 92 to disengage from the protrusion 94, thereby releasing the firing pin 22. The released firing pin 22 is propelled towards the pilot valve 48 by the spring 88.

Figure 6C:
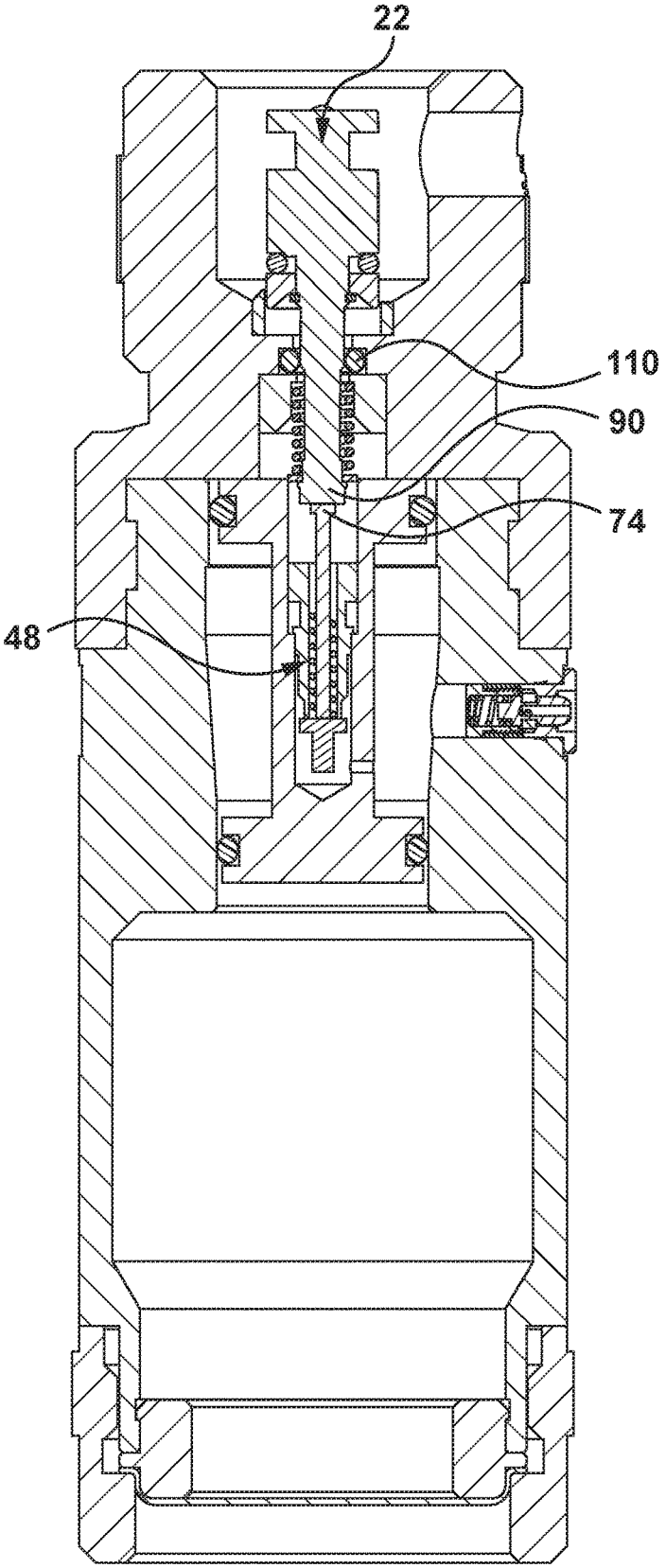

As shown in FIG. 6C, the end 90 of firing pin 22 is propelled into contact with the end 74 of the pilot valve 48. Further, the wider neck portion of the firing pin 22 contacts the seal 110 for prevent gas from escaping past the firing pin 22.

Figure 6D:
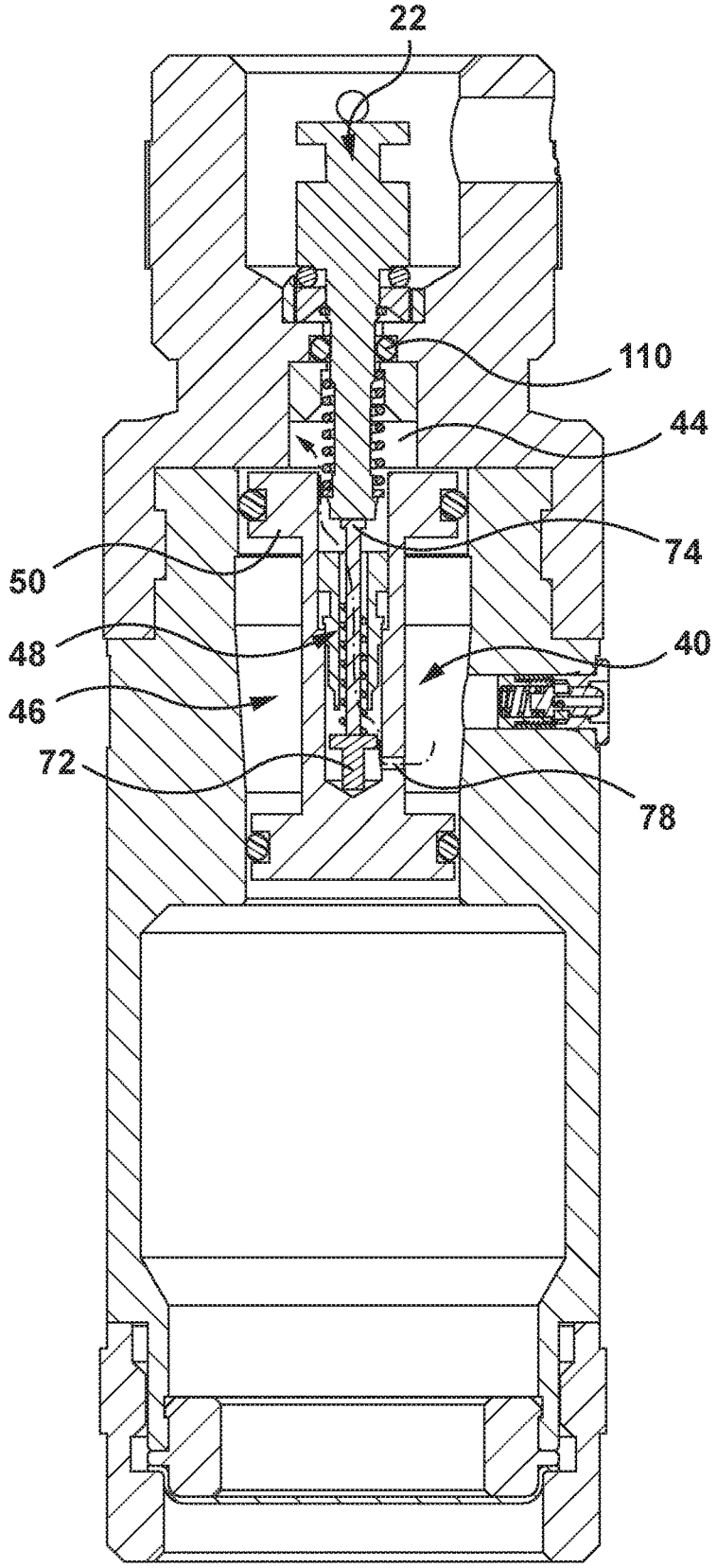

As shown in FIG. 6D, the continued movement of the firing pin 22 presses the end 74 of the pilot valve 48 to open the pilot valve 48, which allows pressurized gas to move, via inlet port 78 and opened seal 72, from the holding chamber 40 into the driving chamber 44, which has been sealed against reverse outflow at the seal 110. Pressure quickly builds against the piston 50 until sliding resistance of the shuttle 46 is overcome.

Figure 6E:
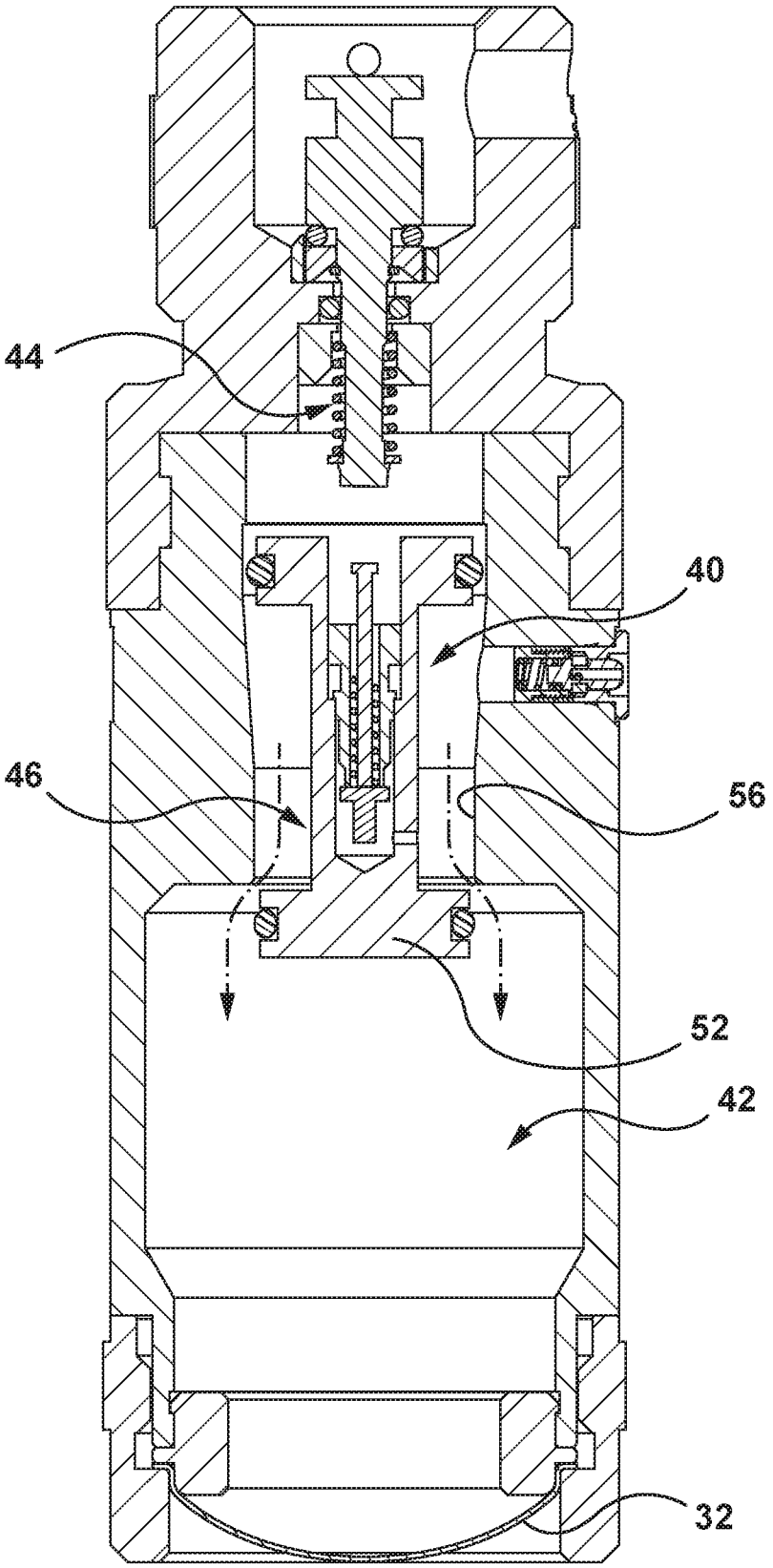

As shown in FIG. 6E, the pressure in the driving chamber 44 pushes the shuttle 46 into the open position to a point where the main valve 52 has disengaged from the inner wall 56 of the holding chamber 40. This allows the pressurized gas remaining in the holding chamber 40 to flow into the expansion chamber 42. The pressure in the expansion chamber 42 quickly exceeds the strength of the rupturable element 32, which ruptures to produce a sound. The rupturable element 32 can be replaced and this process can be repeated as often as desired. In embodiments that eject paint, powder, or projectile, pressure in the expansion chamber 42 triggers the ejection of such, and after operation the charge can be replaced.

Figure 7:
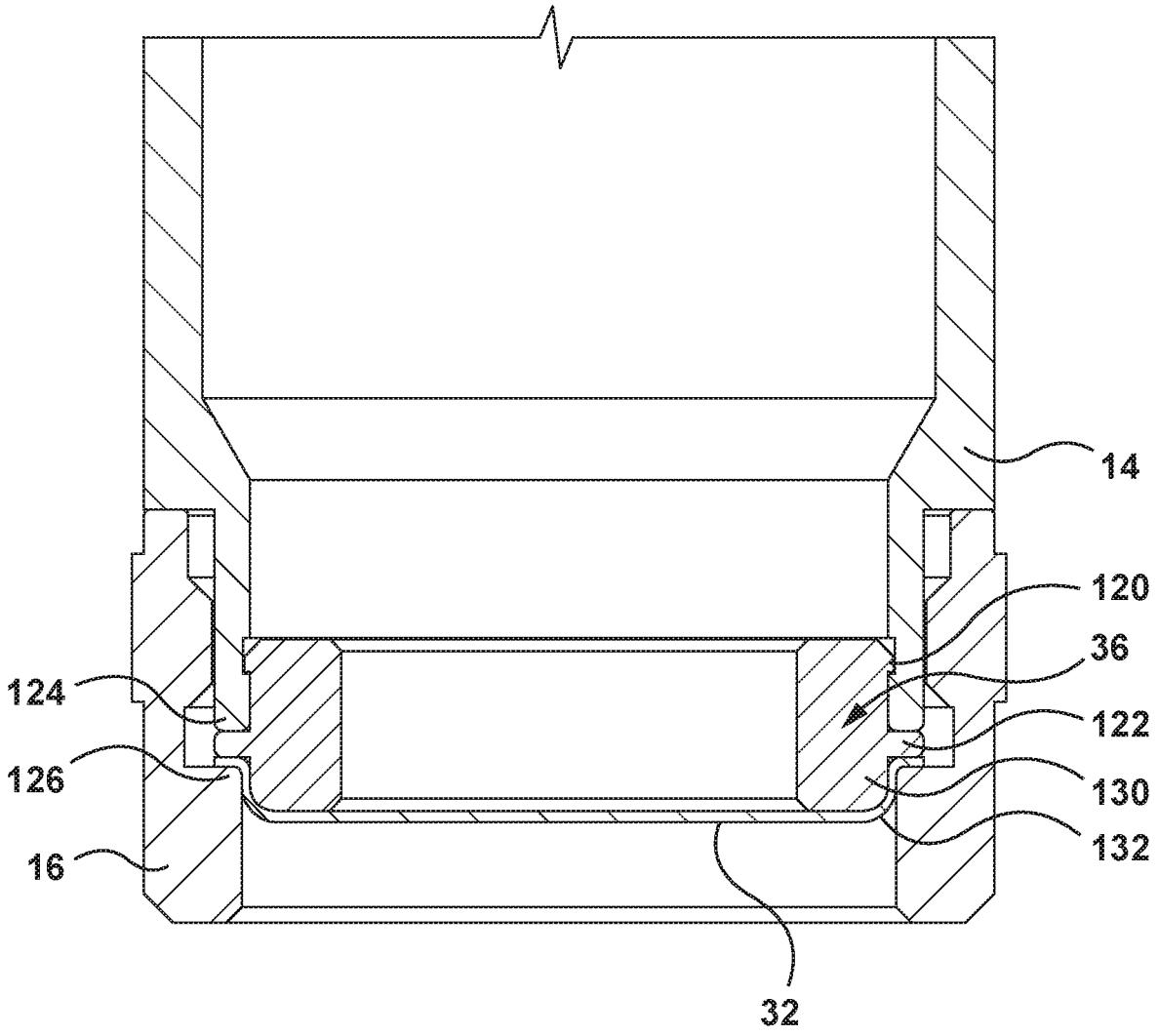
FIG. 7 is a close-up cross-sectional view of the discharging end of the reusable simulated weapon.

FIG. 7 shows the rupturable element 32 clamped between the clamp ring 36 and the end cap 16. The clamp ring 36 is generally cylindrical and annular in shape. In this embodiment, the clamp ring 36 is connected to the main body 14 by mating ridge and groove structures at 120. Any suitable connection structure can be used, and the ridge and groove structures are but one example. The outside cylindrical surface of the clamp ring 36 has an annular rib 122 that is shaped to be held between the cylindrical end 124 of the main body 14 and an inside land 126 of the end cap. The perimeter of the rupturable element 32 is positioned between the rib 122 and the land 126, so that the rupturable element 32 is held fixed between the clamp ring 36 and the end cap 16. The end of the clamp ring 36 nearest the rupturable element 32 has a contour 130 of a radius suitable to form a gentle contour 132 in the rupturable element 32 near its perimeter. The clamp ring 36 is made from a material that is softer than the material of the end cap 16 and the main body 14. In this embodiment, the clamp ring 36 is machined from acetal resin (e.g., Delrin®) or similar material.

The rupturable element 32, in this embodiment, is a thin membrane that, prior to loading, is normally in the shape of a flat disc. During loading, the membrane 32 is placed inside the end cap 16 and into contact with the land 126, Then, the end cap 16 is threaded onto the main body 14, which effectively causes the contour 130 of the clamp ring 36 to draw form the membrane 32 into the end cap 16 just before the perimeter of the membrane 32 is clamped by the rib 122 and land 126, providing reliable perimeter clamping of the membrane 32 without cutting or damaging it. This consistent clamping effect around the entire circumference of the rupturable membrane 32 results in consistently loud sonic effect from membranes 32 during repeated uses.

In view of the above, it should be apparent that the present invention offers numerous advantages. The firing pin described offers good triggering reliability and facilitates a simple resetting procedure. Further, the structures and mechanisms disclosed are readily manufacturable. Moreover, the present invention can be operated using commonly available and low-cost consumables, such as propane at readily available pressures, that, in conjunction with the structures and mechanisms disclosed, produces an impressive effect.

While the foregoing provides certain non-limiting examples, it should be understood that combinations, subsets, and variations of the foregoing are contemplated. The monopoly sought is defined by the claims.

What is claimed is:

1. A reusable simulated weapon device, the device comprising:

a body defining a holding chamber for holding a pressurized gas, the body further defining an expansion chamber in communication with the holding chamber for receiving expanding gas from the holding chamber;

a shuttle slidable between a closed position that blocks communication between the holding chamber and the expansion chamber and an open position that allows communication between the holding chamber and the expansion chamber, the shuttle having a pilot valve that when opened causes pressurized gas in the holding chamber to drive the shuttle from the closed position to the open position; and a firing pin for opening the pilot valve, the firing pin having armed position, in which a protrusion engages with a recess to hold the firing pin with respect to the body against a spring, one of the protrusion and the recess being disposed at the firing pin and another of the protrusion and the recess being disposed at the body, the protrusion and recess shaped to release the firing pin from the armed position in response to an impact to the body, the spring positioned to drive the firing pin, when released from the armed position, to actuate the pilot valve, causing the shuttle to slide from the closed position to the open position to allow gas to move into the expansion chamber.

2. The device of claim 1, wherein the body is configured to hold a rupturable element that encloses the expansion chamber, the rupturable element configured to rupture in response to pressure of gas in the expansion chamber, so as to emit a sound.

3. The device of claim 2, wherein the rupturable element is a membrane, the device further comprising a clamp ring within the body for clamping a perimeter of the membrane to the body, the clamp ring being made of a material softer than the body and the clamp ring having a contour that forms a contour in the membrane.

4. The device of claim 1, wherein the protrusion extends from the body and the recess is on the firing pin.

5. The device of claim 4, wherein the firing pin comprises a bearing portion having a concave surface that defines the recess, the concave surface for contact with the protrusion in the armed position.

6. The device of claim 5, wherein the firing pin comprises a pin portion and the bearing portion as separate pieces, the pin portion for actuating the pilot valve, the firing pin further comprising a resilient member disposed between the pin portion and the bearing portion for absorbing impact to reduce damage to the concave surface by the protrusion.

7. The device of claim 5, wherein the concave surface has a frustoconical shape.

8. The device of claim 7, wherein the protrusion is beveled to complement the frustoconical shape of the concave surface.

9. The device of claim 1, wherein the firing pin comprises a pin portion for actuating the pilot valve and a rear portion, the protrusion and recess located along the length of the firing pin between the pin portion and the rear portion, the rear portion sized to provide inertia to disengage the protrusion and recess in response to the impact to the body.

10. The device of claim 9, wherein the body comprises at least one hole positioned near the rear portion of the firing pin, the hole for receiving a safety pin that holds the firing pin in the armed position.

11. The device of claim 1, wherein the body and shuttle define a driving chamber in communication with the holding chamber as controlled by the pilot valve, gas pressure in the driving chamber driving the shuttle from the closed position to the open position, the driving chamber having a passage through which a pin portion of the firing pin extends to actuate the pilot valve, the firing pin being shaped to seal the passage when the pin portion actuates the pilot valve.

12. The device of claim 11, wherein the pin portion of the firing pin and the passage into the driving chamber are shaped to allow gas to pass through the opening when the firing pin is in the armed position.

* * * * *